US008292000B2

(12) United States Patent
Takami et al.

(10) Patent No.: US 8,292,000 B2
(45) Date of Patent: Oct. 23, 2012

(54) EARTH MOVING DEVICE FOR WORKING VEHICLE

(75) Inventors: Souta Takami, Fukuoka (JP); Akashi Ikematsu, Fukuoka (JP); Katsuyoshi Tsujimura, Fukuoka (JP); Yoshihiro Hayami, Fukuoka (JP); Kanako Koyama, Fukuoka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 12/920,653

(22) PCT Filed: Feb. 3, 2009

(86) PCT No.: PCT/JP2009/051778

§ 371 (c)(1),
(2), (4) Date: Sep. 2, 2010

(87) PCT Pub. No.: WO2009/110274

PCT Pub. Date: Sep. 11, 2009

(65) Prior Publication Data

US 2011/0011604 A1 Jan. 20, 2011

(30) Foreign Application Priority Data

Mar. 6, 2008 (JP) ..... 2008-056919

(51) Int. Cl.
*E02F 3/85* (2006.01)

(52) U.S. Cl. ..... 172/813; 172/818

(58) Field of Classification Search ..... 172/813, 172/815, 818, 819, 820, 821
See application file for complete search history.

(56) References Cited

U.S. PATENT DOCUMENTS

| | | | | | |
|---|---|---|---|---|---|
| 2,766,536 | A | * | 10/1956 | Perkins | 172/812 |
| 3,512,283 | A | * | 5/1970 | Moody et al. | 37/403 |
| 3,648,782 | A | * | 3/1972 | Mazzarins | 172/821 |
| 3,674,096 | A | * | 7/1972 | Berg | 172/821 |
| 3,997,986 | A | * | 12/1976 | Black et al. | 37/419 |
| 4,074,448 | A | * | 2/1978 | Niemela | 37/234 |
| 4,074,769 | A | * | 2/1978 | Frisbee | 172/813 |
| 4,074,770 | A | * | 2/1978 | Frisbee | 172/813 |
| 4,111,268 | A | * | 9/1978 | Frisbee | 172/813 |
| 4,201,268 | A | * | 5/1980 | Frisbee | 172/812 |
| 4,237,986 | A | * | 12/1980 | Frisbee | 172/813 |

(Continued)

FOREIGN PATENT DOCUMENTS

JP 10-219732 8/1998

(Continued)

OTHER PUBLICATIONS

International Search Report for International Application No. PCT/JP2009/051778, Japanese Patent Office mailed May 19, 2009, 1 pg.

(Continued)

*Primary Examiner* — Jamie L McGowan
(74) *Attorney, Agent, or Firm* — Sterne, Kessler, Goldstein & Fox P.L.L.C.

(57) ABSTRACT

An earth moving device for a working vehicle, in which earth and sand flowing rearward over an earth moving blade does not enter through a gap between a bush and a piston rod into an angle cylinder tube. An angle cylinder is formed by including an angle cylinder rod and an angle cylinder tube. The angle cylinder rod is pivotably supported on a vertically movable frame, and the angle cylinder tube is pivotably supported on the earth moving blade.

2 Claims, 5 Drawing Sheets

U.S. PATENT DOCUMENTS

| | | | | | |
|---|---|---|---|---|---|
| 4,281,721 | A * | 8/1981 | Beales | 172/821 |
| 4,405,019 | A * | 9/1983 | Frisbee | 172/816 |
| 4,828,044 | A * | 5/1989 | Horsch et al. | 172/821 |
| 4,828,045 | A * | 5/1989 | Horsch et al. | 172/821 |
| 4,893,683 | A * | 1/1990 | Horsch et al. | 172/821 |
| 5,010,961 | A * | 4/1991 | Frisbee | 172/821 |
| 5,152,351 | A * | 10/1992 | Rieger | 172/813 |
| 6,578,296 | B2 * | 6/2003 | Kimoto et al. | 37/443 |
| 6,659,194 | B1 * | 12/2003 | Thompson | 172/818 |
| 6,843,005 | B2 * | 1/2005 | Clapper | 37/406 |
| 2011/0067892 | A1 * | 3/2011 | Miyuki et al. | 172/813 |

FOREIGN PATENT DOCUMENTS

| | | | |
|---|---|---|---|
| JP | 2000-008409 | A | 1/2000 |
| JP | 2006-233641 | | 9/2006 |
| JP | 2007-162313 | | 6/2007 |
| JP | 2008-240340 | A | 10/2008 |

OTHER PUBLICATIONS

English Translation of the International Preliminary Report on Patentability for International Application No. PCT/JP2009/051778, Japanese Patent Office mailed Nov. 18, 2010, 6 pgs.

* cited by examiner

EARTH MOVING DEVICE FOR WORKING VEHICLE

BACKGROUND

1. Technical Field

The present invention relates to arrangement of an angle cylinder in an earth moving device for a working vehicle.

2. Background Art

Conventionally, there is a well-known earth moving device which is provided in a working vehicle so as to remove earth, sand and the like. The earth moving device can perform various earth moving works such as excavation, carriage and accumulation of earth, sand and the like, leveling of a road surface and a ground surface, and backfilling after excavation. The earth moving device includes a vertically movable arm attached to a travel unit rotatably vertically, an earth moving blade attached to the vertically movable arm rotatably laterally, and a hydraulic cylinder serving as an angle cylinder for rocking the earth moving blade laterally. For example, the Japanese Patent Laid Open Gazette 2007-162313 discloses a hydraulic shovel having an earth moving device.

The hydraulic cylinder serving as the angle cylinder includes a piston, an angle cylinder rod fixed to the piston at one of ends thereof, an angle cylinder tube in which the piston is housed slidably, a head cover fixed to one of ends of the angle cylinder tube, a rod cover penetrated by the angle cylinder rod at the other of the ends of the angle cylinder tube, and a bush provided at the portion of the rod cover penetrated by the angle cylinder rod so as to have the angle cylinder rod slidable therethrough.

At the earth moving work, earth and sand may flow rearward over the blade of the earth moving device. In the earth moving device disclosed in the Japanese Patent Laid Open Gazette 2007-162313, the angle cylinder rod is pivotally supported on the blade. As a result, it has a defect that the earth and sand flowing rearward over the blade enter through a gap between the bush and the piston rod into the angle cylinder tube.

BRIEF SUMMARY

The present invention is provided in consideration of the conditions as mentioned above, and the purpose of the invention is to provide an earth moving device for a working vehicle, in which earth and sand flowing rearward over an earth moving blade does not enter through a gap between a bush and a piston rod into an angle cylinder tube.

According to the present invention, an earth moving device of the present invention for a working vehicle comprises: a vertically movable frame attached to a travel unit vertically rotatable; an earth moving blade attached to the vertically movable frame laterally rotatable; and an angle cylinder for turning the earth moving blade laterally. The angle cylinder includes an angle cylinder rod and an angle cylinder tube and is arranged so that the angle cylinder rod is pivotally supported by the vertically movable frame and the angle cylinder tube is pivotally supported by the earth moving blade.

In the earth moving device of the present invention, preferably, the angle cylinder is provided on a side surface of the vertically movable frame, and is provided with a cover covering the angle cylinder rod.

In the earth moving device of the present invention, preferably, an opening is provided in a lower portion of the cover.

According to the earth moving device of the present invention, earth and sand flowing rearward over an earth moving blade does not enter through a gap between a bush and a piston rod into an angle cylinder tube.

DETAILED DESCRIPTION

Figure 1:
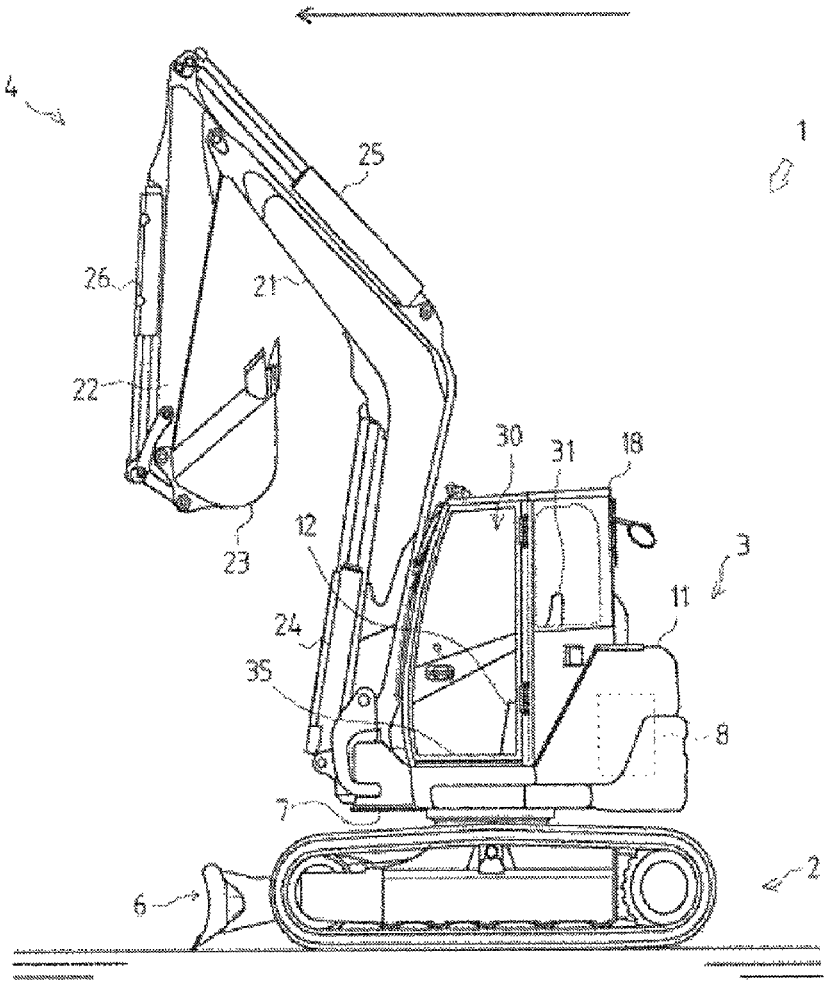
FIG. 1 is a side view of an entire construction of a slewing working vehicle according to an embodiment of the present invention.

Slewing working vehicle 1 according to an embodiment of the present invention shown in FIG. 1 will now be described. In the drawings, to make the following explanation easily understood, it is assumed that arrows are directed in a forward traveling direction.

As shown in FIG. 1, the slewing working vehicle 1 includes a crawler travel unit 2, a slewing body 3 supported on the center of the upper portion of the crawler travel unit 2 so as to be slewable laterally, and an excavation working device 4 attached to the lateral center of the front portion of the slewing body 3. An earth moving device 6 is attached to one of front and rear sides of the crawler travel unit 2 so as to be rotatable vertically, whereby the earth moving device 6 can perform the work of leveling the ground after the excavation work. The details of the earth moving device 6 will be discussed later.

In the slewing body 3, an engine 8 is provided on a rear portion of a slewing base 7. The slewing body 3 is covered at rear, left and right sides thereof by a bonnet 11. The slewing base 7 is provided thereon with a support base 12 extending from a left front portion thereof to a rear portion thereof. The engine 8, a hydraulic pump and the like are arranged below the support base 12. On the other hand, an operation part 30, including a driver seat 31, a controller of various apparatuses, a step 35 and the like, is arranged above the support base 12 and is covered by a cabin 18.

The excavation working device 4 includes a boom 21, an arm 22 and a bucket 23. Each of the boom 21, the arm 22 and the bucket 23 is connected to one of ends of each of cylinders 24, 25 and 26, and is rotatable by the expansion and contraction of the corresponding cylinder. Each of these members of the excavation working device 4 can be rotated by operating the controller of the operation part 30 so as to perform works of the excavation working device 4, such as excavation and loading.

Figure 2:
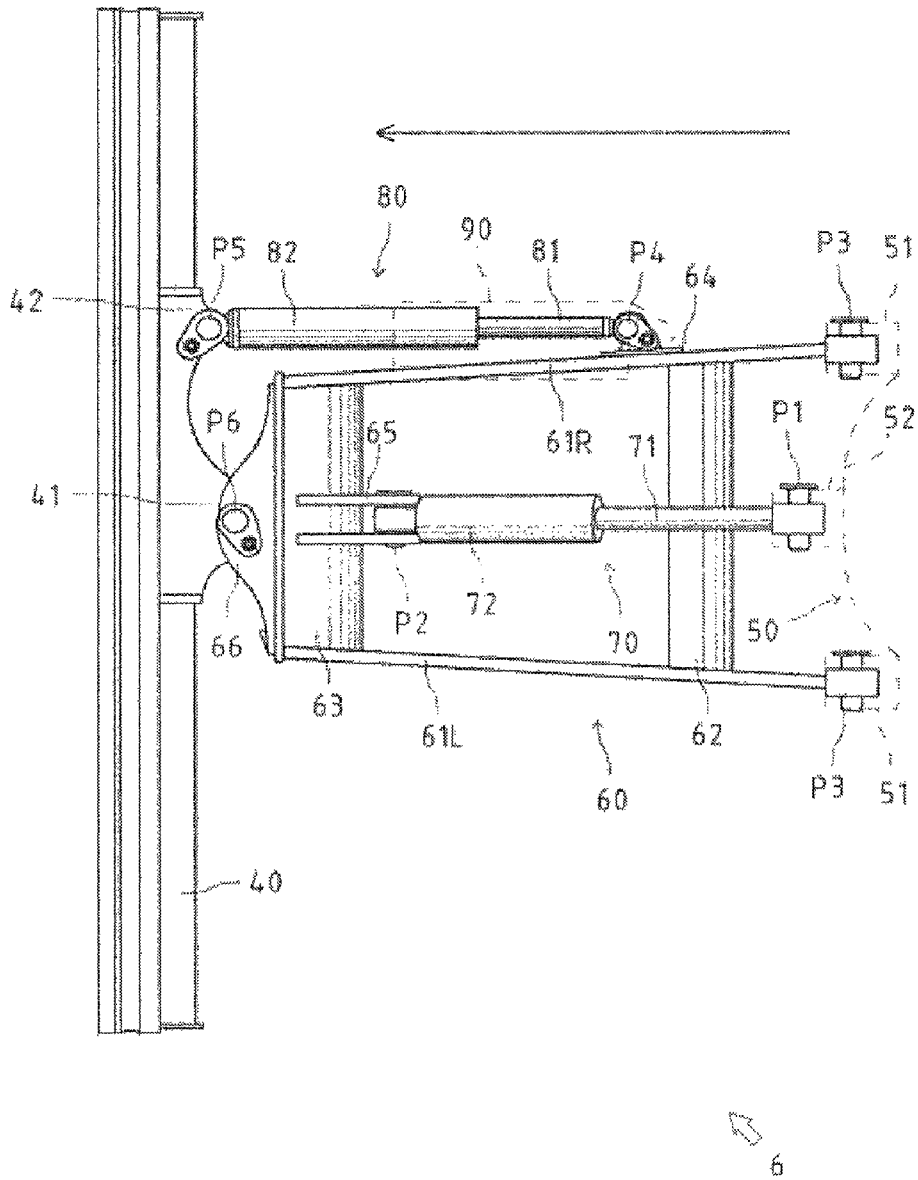
FIG. 2 is a plan view of an earth moving device of the slewing working vehicle.
Figure 3:
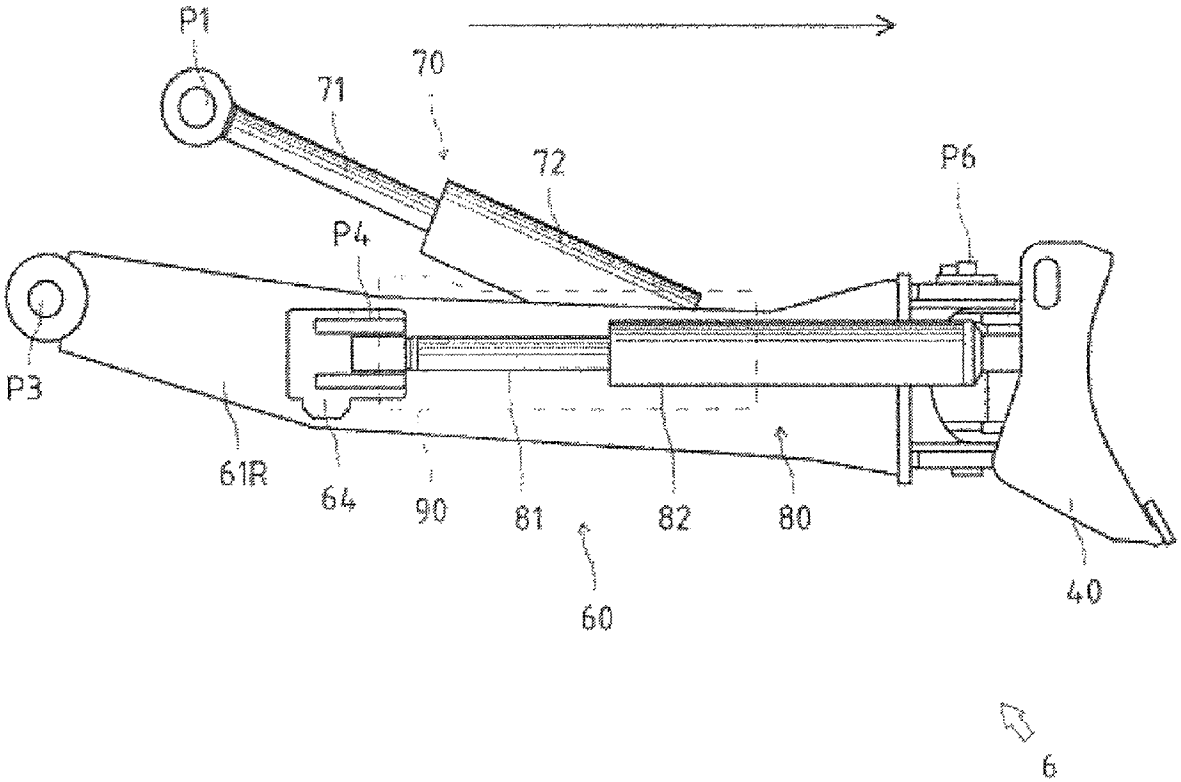
FIG. 3 is a side view of the earth moving device.

The earth moving device 6 as shown in FIGS. 2 and 3 will now be described.

The earth moving device 6 includes a vertically movable frame 60 and an earth moving blade 40.

The vertically movable frame 60 includes a pair of left and right vertically movable arms 61L and 61R extended longitudinally, and reinforcing members 62 and 63 extended laterally between the vertically movable arms 61L and 61R. The vertically movable arms 61L and 61R are arranged to widen a gap therebetween to one end thereof in a shape like an unfolded fun when viewed in plan so as to male lateral locking width of an angle cylinder 80 discussed later large. A cylinder bracket 64 is provided on the outer side of a longitudinal intermediate portion of the vertically movable arm 61R. This portion of the vertically movable arm 61R having the cylinder bracket 64 thereon is close to the reinforcing member 62 so as to have high strength. A cylinder bracket 65 is provided on the rear side of the lateral center of the reinforcing member 63, and a bracket 66 is provided on the front side of the lateral center of the reinforcing member 63.

A track frame 50 supports the crawler travel unit 2. A front portion of the track frame 50 is provided with brackets 51 on left and right sides thereof, and with a cylinder bracket 52 on the lateral center thereof. Explanation of the detailed structure of the track frame 50 is omitted.

The pair of left and right vertically movable arms 61L and 61R are pivotally supported at rear portions thereof so as to be rotatable vertically relative to the brackets 51 and centered on a pivot shaft P3. A vertically movable cylinder 70 includes a vertically movable cylinder rod 71 and a vertically movable cylinder tube 72. The vertically movable cylinder rod 71 is pivotally supported so as to be rotatable vertically relative to the cylinder bracket 52 and centered on a pivot shaft P1. The vertically movable cylinder tube 72 is pivotally supported so as to be rotatable vertically relative to the cylinder bracket 65 and centered on a pivot shaft P2. According to this construction, by the expansion and contraction of the vertically movable cylinder 70, the vertically movable frame 60 is rotated vertically relative to the track frame 50 and centered on the pivot shaft P3.

A rear side portion of the earth moving blade 40 is provided with a bracket 41 on the lateral center thereof, and with a cylinder bracket 42 on the right side of the bracket 41.

The bracket 41 is pivotally supported so as to be rotatable laterally relative to the bracket 66 and centered on a pivot shaft P6. The angle cylinder 80 includes an angle cylinder rod 81 and an angle cylinder tube 82. The angle cylinder rod 81 is pivotally supported so as to be rotatable laterally relative to the cylinder bracket 64 and centered on a pivot shaft P4. The angle cylinder tube 82 is pivotally supported so as to be rotatable laterally relative to the cylinder bracket 42 and centered on a pivot shaft P5. According to this construction, by the expansion and contraction of the angle cylinder 80, the earth moving blade 40 is rotated laterally relative to the vertically movable frame 60 and centered on the pivot shaft P6.

The angle cylinder 80 shown in FIG. 4 will now be described.

Figure 4:
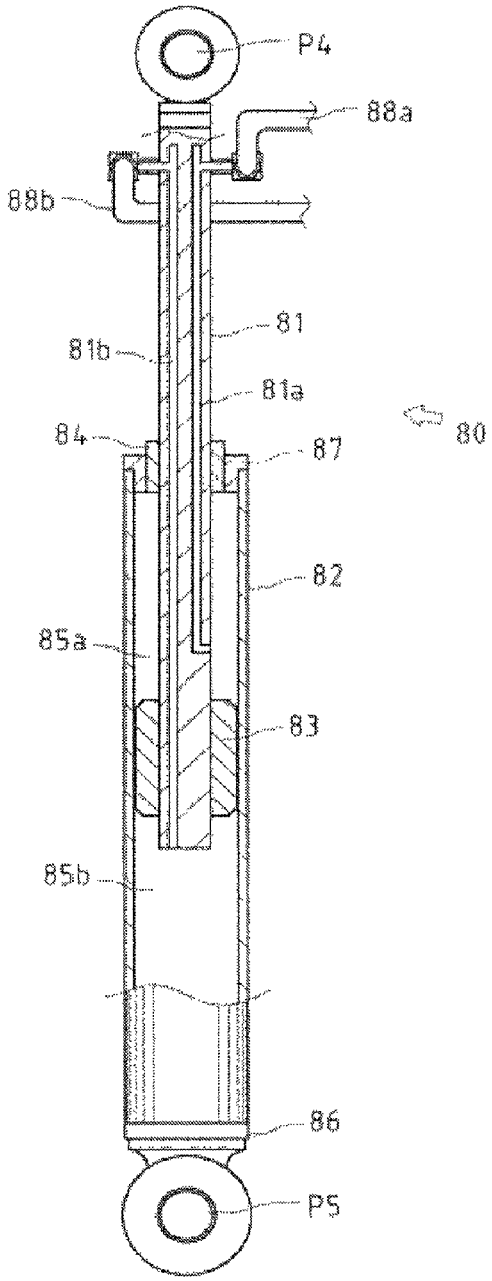
FIG. 4 is a plan view partially in section of an angle cylinder of the earth moving device.

As shown in FIG. 4, the angle cylinder 80 includes a piston 83, the angle cylinder rod 81 fixed to the piston 83 at one of its ends, the angle cylinder tube 82 housing the piston therein slidably, a head cover 86 fixed to one of ends of the angle cylinder tube 82, a rod cover 87 penetrated by the angle cylinder rod 81 at the other of the ends of the angle cylinder tube 82, and a bush 84, which is provided at the portion of the rod cover 87 penetrated by the angle cylinder rod 81 so as to have the angle cylinder rod 81 slidable therein.

Two oil passages 81*a* and 81*b* are formed inside the angle cylinder rod 81, and hydraulic pipes 88*a* and 88*b* respectively communicated with the oil passages 81*a* and 81*b* are connected to the tip of the angle cylinder rod 81. The oil pipes 88*a* and 88*b* are connected to respective hydraulic hoses (not shown), and the other ends of the hydraulic hoses are connected to a control valve. On the other hand, in the angle cylinder tube 82, the oil passages 81*a* and 81*b* are connected to a rod side chamber 85*a* and a head side chamber 85*b* respectively.

Conventionally, an angle cylinder is constructed so that hydraulic pipes were connected to its angle cylinder tube. As a result, to be prevented from interfering with the hydraulic pipes when the earth moving blade is laterally rocked, the angle cylinder is arranged so that an angle cylinder rod is pivotally supported by the earth moving blade and the angle cylinder tube is pivotally supported by the vertically movable frame.

However, in this embodiment, the angle cylinder 80 is connected to the hydraulic pipes 88*a* and 88*b* at the angle cylinder rod 81, thereby being prevented from interfering with the hydraulic pipes 88*a* and 88*b* when the earth moving blade 40 is laterally rocked. Therefore, the angle cylinder 80 is arranged so that the angle cylinder tube 82 is pivotally supported by the earth moving blade 40 and the angle cylinder rod 81 is pivotally supported by the vertically movable frame 60. According to this construction, earth and sand flowing rearward over the earth moving blade 40 does not enter through a later-discussed gap between the bush 84 and the angle cylinder rod 81 into the angle cylinder tube 82.

The cover 90.

shown in FIG. 5 will now be described.

The cover 90 is formed by a plate member which is bent to be U-like shaped in sectional front view and to have the open side thereof directed to the vertically movable arm 61L (see FIGS. 2 and 3). The cover 90 covers the angle cylinder rod 81 and is detachably attached to the vertically movable arm 61L with bolts or the like. By the expansion and contraction of the angle cylinder 80, the length of stretching of the angle cylinder rod 81 from the angle cylinder tube 82 is changed. However, the cover 90 is enough long to cover the whole angle cylinder rod 81 stretching from the angle cylinder tube 82 even if the angle cylinder rod 81 fully stretches.

According to the construction, when the angle cylinder 80 expands or contracts, the upper, side and lower portions of the exposed part of the angle cylinder rod 81 are covered by the cover 90. Therefore, earth and sand splashed by the crawler travel unit 2 and earth and sand flowing rearward over the earth moving blade 40 does not enter through the gap between the bush 84 and the angle cylinder rod 81 into the angle cylinder tube 82.

Figure 5:
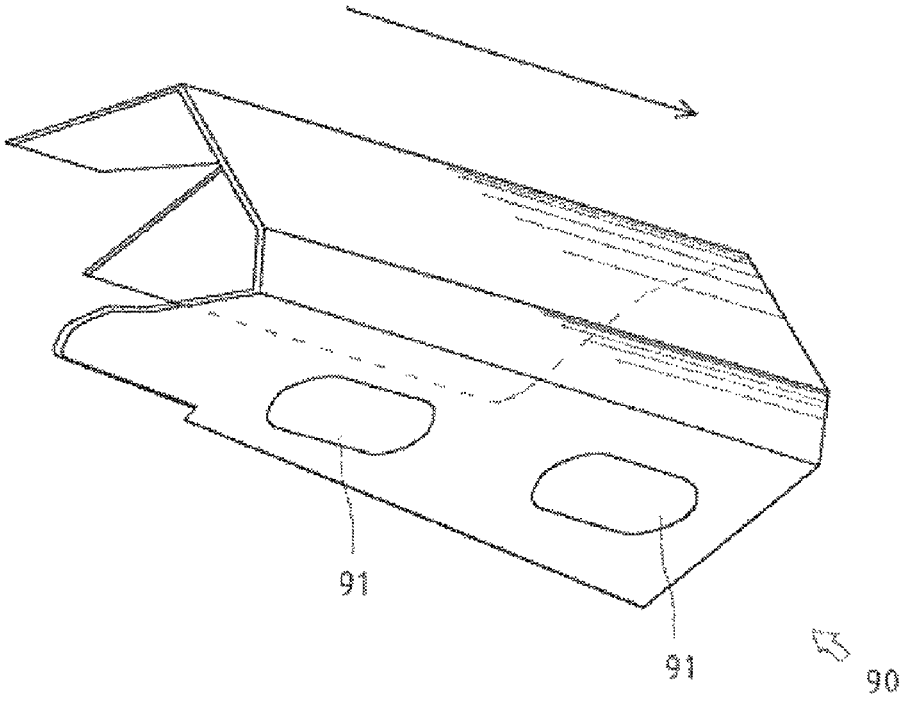
FIG. 5 is a perspective view of a cover of the angle cylinder.

As shown in FIG. 5, in the lower portion of the cover 90, openings 91 of substantially oval shape are provided at two positions, i.e., front and rear positions. In this embodiment, dimensions, number and shape of the openings 91 are not limited especially.

According to the construction, when earth and sand flowing rearward over the earth moving blade 40 or earth and sand splashed by the crawler travel unit 2 enters into the cover 90, the earth and sand can be discharged through the openings 91. As a result, the earth and sand can be prevented from being accumulated inside the cover 90.

INDUSTRIAL APPLICABILITY

The present invention is adaptable to an earth moving device for a slewing working vehicle.

The invention claimed is:

1. An earth moving device of a working vehicle comprising:

a vertically movable frame attached to a travel unit so as to be vertically rotatable;

an earth moving blade attached to the vertically movable frame so as to be laterally rotatable;

an angle cylinder for laterally turning the earth moving blade, wherein the angle cylinder includes an angle cylinder rod and an angle cylinder tube and is arranged so that the angle cylinder rod is pivotally supported by a side surface of the vertically movable frame and the angle cylinder tube is pivotally supported by the earth moving blade; and a cover which covers the angle cylinder rod and is detachably attached to the vertically movable frame, wherein the cover is a plate member bent in a U-shape so as to include a horizontal upper portion, disposed above the angle cylinder rod, a horizontal lower portion, disposed below the angle cylinder rod, and a vertical side portion, extended between the horizontal upper and lower portions and disposed aside of the angle cylinder rod, and wherein a hole for discharging earth or sand is provided in the horizontal lower portion of the cover.

2. The earth moving device of the working vehicle according to claim 1, wherein the angle cylinder tube includes a first end pivotally connected to the earth moving blade, and includes a second end through which the angle cylinder rod passes, wherein the angle cylinder rod includes a first end pivotally connected to the vertically movable frame, and includes a second end having a piston thereon in the angle cylinder tube, wherein the piston divides an inside space of the angle cylinder tube into a first chamber on the side of the first end of the angle cylinder tube and a second chamber on the side of the second end of the angle cylinder tube, wherein a pair of oil passages are formed inside the angle cylinder rod so as to be connected to the first and second chambers respectively, wherein a pair of connection portions are provided on the first end of the angle cylinder rod so as to be connected to the respective oil passages, wherein a pair of hydraulic pipes are fluidly connected to the respective oil passages via the respective connection portions on the first end of the angle cylinder rod, and wherein the cover covers the connection portions.

* * * * *